United States Patent [19]

Garrett

[11] Patent Number: 4,879,790

[45] Date of Patent: Nov. 14, 1989

[54] METHOD OF MAKING A PROJECTILE HAVING A DRIVING BAND

[75] Inventor: Harold E. Garrett, Santa Ana, Calif.

[73] Assignee: Ford Aerospace Corporation, Newport Beach, Calif.

[21] Appl. No.: 243,223

[22] Filed: Sep. 2, 1988

Related U.S. Application Data

[60] Continuation of Ser. No. 41,029, Apr. 20, 1987, abandoned, which is a division of Ser. No. 934,525, Nov. 24, 1986, Pat. No. 4,754,708.

[51] Int. Cl.[4] ..... B21K 21/06

[52] U.S. Cl. ..... 29/1.2; 29/1.23

[58] Field of Search ..... 29/1.2, 1.23; 102/526, 102/527

[56] References Cited

U.S. PATENT DOCUMENTS 4,519,117 5/1985 Götz et al. ..... 29/1.2

*Primary Examiner*—Timothy V. Eley

*Attorney, Agent, or Firm*—Peter Abolins; Clifford L. Sadler

[57] ABSTRACT

An ammunition round has a plastic molded driving band on a projectile. The driving band is mechanically attached to the projectile by opposing curved hooks bent toward one another and defining a restraining area therebetween. The seating area for the driving band has a plurality of pairs of such hooks circumferentially and longitudinally displaced from one another.

2 Claims, 2 Drawing Sheets

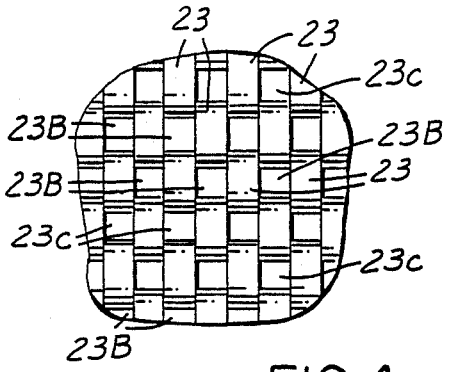
FIG.4
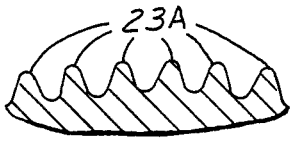
FIG.5
FIG.6
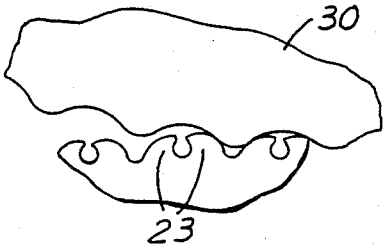
FIG.7
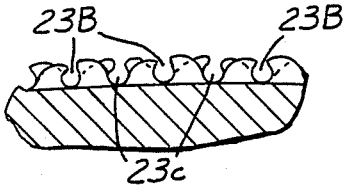
FIG.8
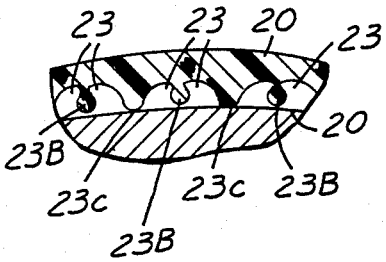
FIG.9
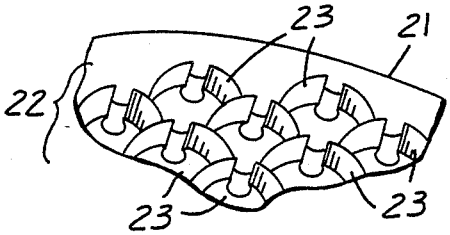

METHOD OF MAKING A PROJECTILE HAVING A DRIVING BAND

STATEMENT OF GOVERNMENT INTEREST

The United States government has a paid-up license in this invention and the right in limited circumstances to require the patent owner to license others or reasonable terms as provided for by the terms of an Air Force contract.

This application is a continuation of application Ser. No. 041,029, filed Apr. 20, 1987, now abandoned.

BACKGROUND OF THE INVENTION

1. Field of the Invention

This invention relates to a projectile of an ammunition round and, in particular, to the attachment of a driving band to the projectile.

2. Prior Art

Driving bands on projectiles are slightly radially enlarged portions of the projectile which act to obturate the barrel thus providing a seal so that the expanding gases from the firing of the ammunition round can drive the projectile through the barrel. Further, the driving band is engraved through interference with the rifling and causes the projectile to spin. This acts to stabilize the projectile so that it may be propelled accurately.

It is known to use copper or soft iron bands for such driving bands but these tend to wear the barrel quickly. The use of plastic for driving bands is also known. However, there has been difficulty in attaching these plastic driving bands to the projectile. One known relatively expensive method is to spray a porous metal so as to secure the plastic to the projectile. This interlock is hard to obtain. The interlock cannot be relied upon due to variability of processing parameters. Such processing parameters include having sufficient porosity in the sprayed-on metal so the plastic can be received. Also, the use of sprayed-on metal requires an additional interface that can separate from the projectile. The uniformity and reliability of the interlock cannot be readily verified without destructive testing.

Some bands have been secured to the projectile body through the use of various dovetail configurations in the projectile body. Such configurations require a band depth of approximately 0.050 inch. This is a significant disadvantage in the design of a projectile body because the wall thickness at the band area of the projectile body must be increased. This adds to the weight of the projectile and reduces the amount of explosive that can be stored inside the projectile body. Attempts were made to solve this problem by using either a metal sprayed surface or a wire mesh attached to the projectile to provide a porous surface for retention of the driving bands. Neither of these approaches were fully successful due to failure of either the primary or secondary attachment, or an inability to verify consistency of the attachments.

There still remains a need for a simple, secure mechanical coupling of the driving band to the projectile. In accordance with this invention, driving bands are able to perform at higher velocities and withstand the more harsh environment of telescoped ammunition. Other systems used in the past (copper bands, soft iron bands, plastic bands with deep dovetails, etc.) will not perform adequately in this environment at shallow seat depths.

SUMMARY OF THE INVENTION

This invention includes an ammunition round having a projectile with a plastic driving band molded onto opposing curved hooks which are integral with the projectile. Advantageously, the curved hooks are formed by forming longitudinal ridges along the length of the projectile region to which the driving band is to be coupled. Then pairs of ridges are bent toward one another to form the opposing curved hooks and an intermediate restraining area. Longitudinally adjacent portions of each ridge are bent in opposing direction so that longitudinally adjacent restraining areas are circumferentially displaced from one another. The result is a checker board pattern when viewed in plan which provides a uniform, verifiable and predictable area of mechanical coupling between the projectile and the driving band.

The method and structure for attaching plastic driving bands to a projectile uses a mechanical design that is an integral part of the projectile body. Thus, the possibility of failure of a secondary attachment is eliminated. Further, this design permits a significantly shallower band seat depth in the projectile body. This shallower band seat saves weight and allows more space for explosives. It can be readily appreciated that the deeper the band seat must go in towards the center of the projectile, the less room there is in the interior for explosives.

BRIEF DESCRIPTION OF THE DRAWING

FIG. 4 is an enlarged view of a portion of the checker board pattern of FIG. 3;

FIG. 5 is a section view along line 5—5 of FIG. 3 of longitudinal ridges which have been formed in a projectile band seat, before the ridges have been bent;

FIG. 6 shows the knurling process whereby adjacent ridges are bent toward each ohter to form an intervening restraining area;

FIG. 7 is a section view along line 7—7 of FIG. 3 showing that longitudinally adjacent portions of the ridges have been bent in opposite directions so that the plurality of restraining areas along the side of any one ridge are located on alternate sides along the length of the ridge;

FIG. 8 is a cross-section view along section line 8—8 of FIG. 2 showing a molded driving band secured by opposing curved hooks with intermediate restraining areas; and FIG. 9 is a perspective view of the checker board pattern of FIG. 4 in a direction parallel to the original ridges.

DETAILED DESCRIPTION OF THE INVENTION

Figure 1:
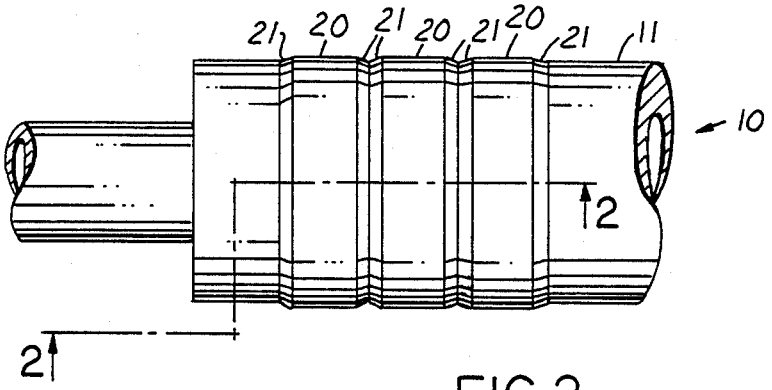
FIG. 1 is a side view, partly broken, of a projectile including mounted driving bands.

Referring to FIG. 1, a projectile 10 includes three circumferential plastic driving bands 20 with side or edge restraints 21. Typical materials for projectile 10 include steel and various steel alloys. A typical material for driving band 20 is a plastic such as polyethersulfone. Driving bands 20 are molded in place on driving band seats 22.

Figure 2:
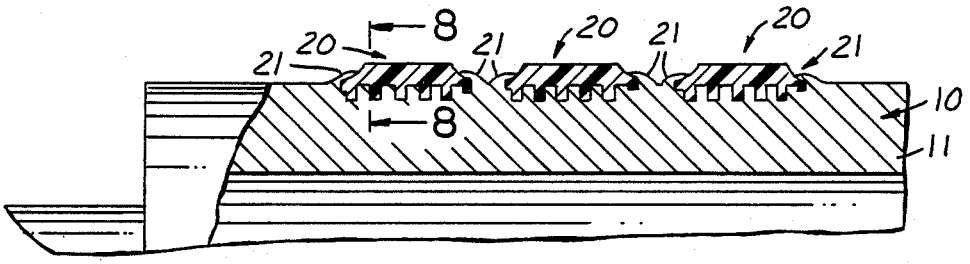
FIG. 2 is a cross-section area through a portion of FIG. 1 including a cross-section of the driving bands.

Driving bands 20 are attached using an integral part of a projectile body 11 and require, for example, a driving band seat 22 depth of only about 0.018 inch. In addition to edge restraints 21, driving bands 20 are secured by the use of mechanical bottom restraints that are part of projectile body 11. Sequential metal forming operations provide side support edge restraints 21 and driving band seats 22 that fill up with plastic during molding. This mechanical retention is resistant to band failure due to band deformation at high velocity initial engagement of the band with the rifling that engraves the band, applies sheer loads, and subsequently centrifugal forces during projectile firing. Referring to FIG. 2, a cross-section shows the in-place molded plastic driving band 20 secured to seat 22 by a curved prong mechanism explained further below and secured on its sides by curved edge restraints 21.

Figure 3:
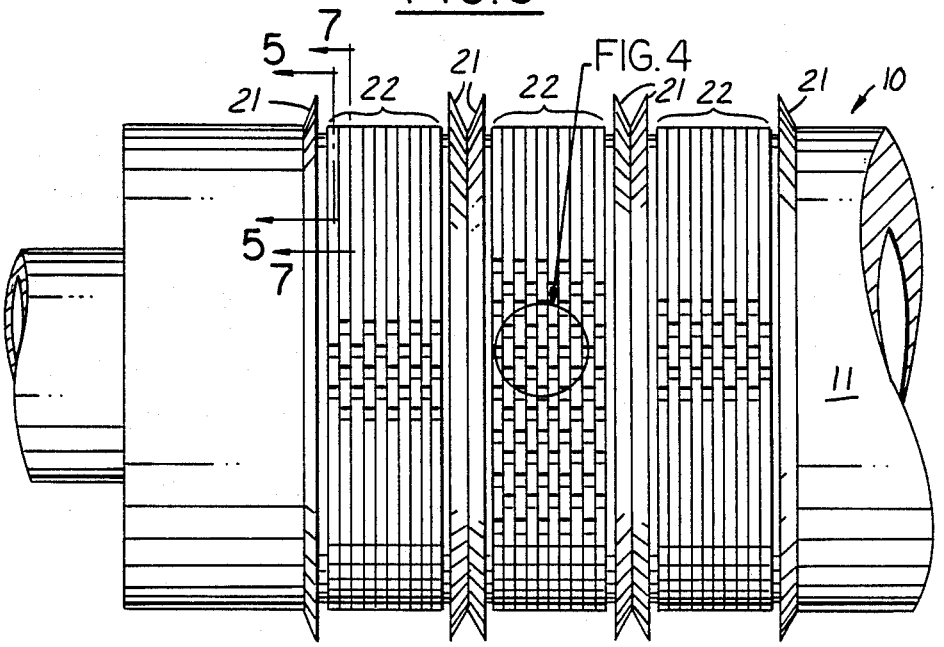
FIG. 3 is a plan view of a partially fabricated driving band seat of a projectile including a region of a checker board pattern with opposing curved hooks.

Referring to FIG. 3, projectile 10 is shown before the in-place molding of plastic driving bands 20. The circumferential edge restraints 21 are in an unbent condition ready to be bent prior to the molding of plastic driving bands 20. Seat region 22, between edge guards 21, contains a plurality of alternating hooks 23. As further discussed below, alternating hooks 23 are bent toward each other. Hooks 23, formed in a portion of seating area 22 of FIG. 3, are shown in enlarged plan view in FIG. 4, and in perspective view in FIG. 9.

Referring to FIG. 5, to form hooks 23, longitudinal ridges 23A are first formed. Ridges 23A have a symmetric peak shape with intermediate valleys. Typically, a knurling operation is used to form the rides and valleys. Referring to FIG. 6, a knurling tool 30 is applied to ridges 23A of FIG. 5 to produce curved ridges which bend toward each other with an intermediate restraining area. Advantageously, knurling tool 30 is shaped so that adjacent portions along the length of ridges 23A are bent in opposing directions as shown in FIG. 7. This can be accomplished by having a relatively thin disc-like knurling tool which is sequentially shifted along the length of a ridge 23A and then rolled to deform a portion of ridge 23A, or having a larger knurling tool with a pluraltiy of longitudinally stacked, circumferentially displaced discs so that one rolling pass across ridges 23A bends sections of the entire length of ridges 23A in opposing directions.

Referring to FIG. 7, the area intermediate adjacent hooks 23 which are bent toward each other is a region 23B for providing interlocking restraint of the molded plastic band 20. In FIG. 8, the flow of plastic into the retaining areas 23B is shown and a cross-section of a finished driving band 20 illustrated. The region between adjacent ridges which are bent away from each other is designated as 23C.

Various modifications and variations will no doubt occur to those skilled in the various arts to which this invention pertains. For example, the particular width of the driving bands and size and shape of the hook pattern, and/or edge restraint configuration, may be varied from that disclosed herein. These and all other variations which basically rely on the teachings through which this disclosure has advanced the art are properly considered within the scope of this invention.

I claim:

1. A method of fabricating a projectile for an ammunition round, including the steps of:

forming an elongated projectile;

knurling a plurality of longitudinally adjacent circumferential paths around the circumference of said projectile to form a plurality of circumferentially alternating longitudinal ridges and valleys;

bending pairs of circumferentially adjacent ridges toward each other forming therebetween a restraining region;

molding a plastic driving band around said projectile so said driving band is mechanically coupled to said projectile by the restraining regions; and wherein the step of bending pairs of circumferentially adjacent ridges toward each other includes bending longitudinally adjacent portions of a first ridge in opposing directions thereby forming a plurality of hook means along said first ridge, adjacent ones of said hook means on said first ridge being curved in opposing circumferential directions, and longitudinally adjacent hook means on said first ridge partially defining circumferentially and longitudinally displaced restraining areas.

2. A method of fabricating a projectile for an ammunition round as recited in claim 1, wherein the step bending pairs of adjacent ridges toward each other includes using a knurling tool having longitudinally adjacent, radial protrustions being circumferentially displaced from one another.

* * * * *